US010145311B1

(12) United States Patent
Reynolds et al.

(10) Patent No.: US 10,145,311 B1
(45) Date of Patent: Dec. 4, 2018

(54) FAULT TOLERANT THROTTLE BODY

(71) Applicants: James Reynolds, Porter Ranch, CA (US); Paul Janson, Northridge, CA (US)

(72) Inventors: James Reynolds, Porter Ranch, CA (US); Paul Janson, Northridge, CA (US)

( * ) Notice: Subject to any disclaimer, the term of this patent is extended or adjusted under 35 U.S.C. 154(b) by 0 days.

(21) Appl. No.: 15/704,263

(22) Filed: Sep. 14, 2017

Related U.S. Application Data

(60) Provisional application No. 62/495,940, filed on Sep. 29, 2016.

(51) Int. Cl.
*F02D 11/10* (2006.01)
*F02D 41/22* (2006.01)

(52) U.S. Cl.
CPC ..... *F02D 11/106* (2013.01); *F02D 41/221* (2013.01); *F02D 2011/102* (2013.01)

(58) Field of Classification Search
CPC ..... F02D 17/04; F02D 31/002; F02D 33/02; F02D 41/0002; F02D 41/221; F02D 41/222; F02D 2041/227; F02D 2009/0235; F02D 2009/0277; F02D 11/106
See application file for complete search history.

(56) References Cited

U.S. PATENT DOCUMENTS 5,429,090 A * 7/1995 Kotchi ..... F02D 9/02 123/396
8,521,403 B2 8/2013 Cook
2015/0100218 A1* 4/2015 Fraser ..... F02D 41/22 701/99
2017/0089287 A1* 3/2017 Kovac ..... F02D 41/0097

OTHER PUBLICATIONS

Grayen, Michael, What is a Fuel System 'Throttle Body'?, pp. 1 to 17, www.carid.com/articles/what-is-fuel-throttle-body.html. 2017 (General Background Info).
"Throttle, Throttle Body", www.wikipedia.org/wiki/throttle#throttle_body, 5 Pages, (General Background Info), 2017.

* cited by examiner

*Primary Examiner* — Erick Solis
*Assistant Examiner* — Anthony L Bacon
(74) *Attorney, Agent, or Firm* — Stan Collier, Esq.

(57) ABSTRACT

The Intelligent Fault Tolerant Throttle Body prevents unintended acceleration of vehicles. This invention solves this emergency by returning the throttle plate to a safe position when commanded by a driver Emergency Button or by brake actuation. The device is installed on a conventional throttle body and comprises an Emergency Button (EB) and a Throttle Motor Controller (TMC). The TMC is a micro controller contained inside the throttle body assembly that intercepts and modifies signals from the engine control unit (ECU) to the Throttle Body Motor (TBM) and monitors the brake switch signal and the throttle position sensor (TPS). The TMC has an internal accelerometer and a throttle pedal sensor input as well as other sensors which are used as additional confirmation of a true unintended acceleration condition and not resulting from ECU, wiring or sensor failures.

13 Claims, 7 Drawing Sheets

PRIOR ART

PRIOR ART

PRIOR ART

FAULT TOLERANT THROTTLE BODY

CROSS REFERENCES TO RELATED APPLICATIONS

The present application claims the benefit of provisional patent application 62/495,940, filed Sep. 29, 2016, titled, "Intelligent Fault Tolerant Throttle Body that Mitigates Unintended Acceleration of Vehicles", by James Reynolds and Paul Janson.

Reference to Federally sponsored research or development: NA

Reference to joint research agreements: NA

Reference to Sequence Listing: NA

BACKGROUND OF THE INVENTION

Field of the Invention

The present invention relates generally to automotive vehicles, and, in particular, relates to devices for controlling the engine, and, in greater particularity, relates to devices for controlling and operating a throttle body thereon.

Description of the Prior Art

In a fuel injected vehicle, FIG. 1, the throttle body 10 is positioned between the engine manifold 12 that routes the air to the engine 14 cylinders from the air filter 16. In the throttle body 10, FIG. 2, a throttle plate 20 is positioned inside of the throttle body assembly and moved by a throttle body motor 22. A throttle position sensor 24 monitors the position of the plate 20 and sends a signal to the (Engine Control Unit) ECU 26 of the vehicle. The ECU further receives signals from the brake, gas pedal, and other sensors in controlling the throttle plate 20. It is a critical component to the engine, and controls acceleration in response to inputs such as the position of the gas pedal. This is shown in the schematic, FIG. 3.

Discussions of the throttle body and its operation are provided in, for example, Wikipedia, "Throttle Body", and in CARid.com, "What is a Fuel System 'Throttle Body'". U.S. Pat. No. 8,521,403 shows a failsafe device that opens a circuit to the ETCM putting the vehicle in idle when an unintended acceleration is detected, incorporated by reference.

Since the advent of electronically controlled throttle bodies there have been numerous cases of unintended acceleration resulting in property damage, injuries, and death. The causes are multiple: sensor failure, electromagnetic interference, microcode bugs, wiring faults, mechanically blocking the accelerator pedal, and others; all of which cause the throttle plate to be commanded to a wide open position.

Accordingly, there is a need for a fault tolerant device in the throttle body to prevent accidents caused by incorrect signals to the throttle plate motor.

SUMMARY OF THE INVENTION

Today's advanced engine design uses numerous sensors and controllers to operate the engine. Check engine lights occur because of erroneous signals from sensors in various parts of the vehicle. Parts become dirty, worn, and just break. The driver in today's modern vehicles has no direct contact to engine devices, but acts through drive-by-wire devices. Although this technology works normally in most situations, instances occur where incorrect signals are generated and thus possible dangerous actions may occur. Faults in the throttle body electronics or parts can cause unintended acceleration.

The Electronic Fault Tolerant Throttle Body prevents unintended acceleration of vehicles. This invention solves this emergency by returning the throttle plate to a safe position when commanded by a combination of the Throttle Position Sensor and a driver Emergency Button actuation or a Start/Stop button or by a brake actuation in response to the unintended acceleration and further including other signals from the ECU which are redundant. The device is installed on a conventional throttle body and comprises a Throttle Motor Controller (TMC). The TMC, is essentially a micro-controller contained inside or outside the throttle body assembly that intercepts and modifies the signals from the engine control unit (ECU) to the Throttle Body Motor (TBM) and monitors the brake switch signal and the throttle position sensor (TPS). The TMC may have an internal accelerometer and a throttle pedal sensor input as well as other sensors which are used as additional confirmation, or redundancy, of a true unintended acceleration condition and not resulting from ECU, wiring or sensor failures.

It is an object of the present invention to provide a device that prevents unintended acceleration of a vehicle;

It is another object of the present invention to provide a device for original equipment manufacturers (OEM) applications wherein the present invention is integrated into a conventional throttle body assembly and requires no special cabling;

It is a further object of the present invention to provide a throttle motor controller that places the throttle plate into a safe Position upon the occurrence of a fault resulting in an unintended acceleration;

It is still a further object of the present invention to provide a TMC that returns engine control to the ECU after corrective signals therefrom or the engine is turned off.

It is still a further object of the present invention to provide a TMC that monitors additional signals from the engine and ECU to create a redundant system to prevent or stop unintended accelerations.

These and other objects, features, and advantages of the present invention will become more readily apparent from the attached drawings and the detailed description of the preferred embodiments, which follow.

BRIEF DESCRIPTION OF THE DRAWINGS

Like reference numerals refer to like parts throughout the several views of the drawings.

DETAILED DESCRIPTION OF THE PREFERRED EMBODIMENTS

The Intelligent Fault Tolerant Throttle Body prevents unintended acceleration of vehicles. This invention solves this emergency by returning the throttle plate to a safe position when commanded by a combination of the Throttle Position Sensor and by a driver Emergency Button actuation or by brake actuation or by other signals in combination. The device is installed on a conventional throttle body and comprises an Emergency Button (EB) and a Throttle Motor Controller (TMC). The TMC is a micro-controller contained inside the throttle body assembly that intercepts and modifies the signals from the engine control unit (ECU) to the Throttle Body Motor (TBM) that moves the throttle plate and monitors the brake switch signal and the throttle position sensor.

The TMC may have an internal accelerometer and a throttle pedal sensor input as well as other sensors which are used as additional confirmation of a true unintended acceleration condition and not resulting from ECU, wiring or sensor failures. By using multiple redundant sensors the TCM is fault tolerant and intercedes only when a true unintended acceleration occurs.

Figure 1:
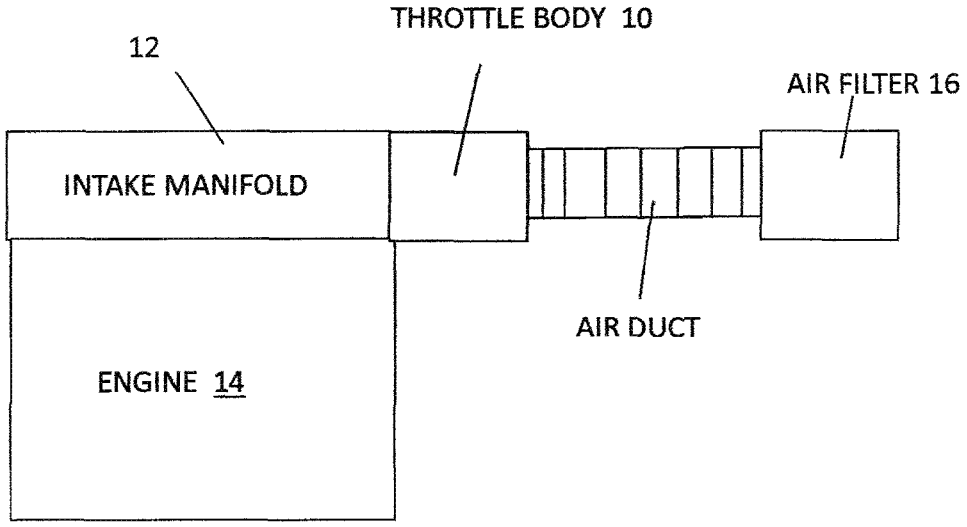
FIG. 1 is a block diagram of an air intake system on an engine as prior art.
Figure 2:
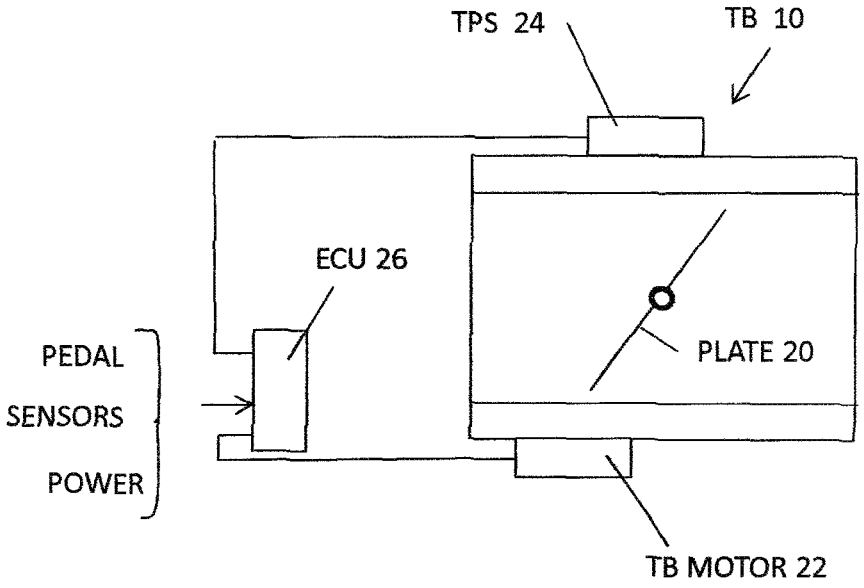
FIG. 2 is a block diagram of a throttle body and associated parts, prior art.
Figure 3:
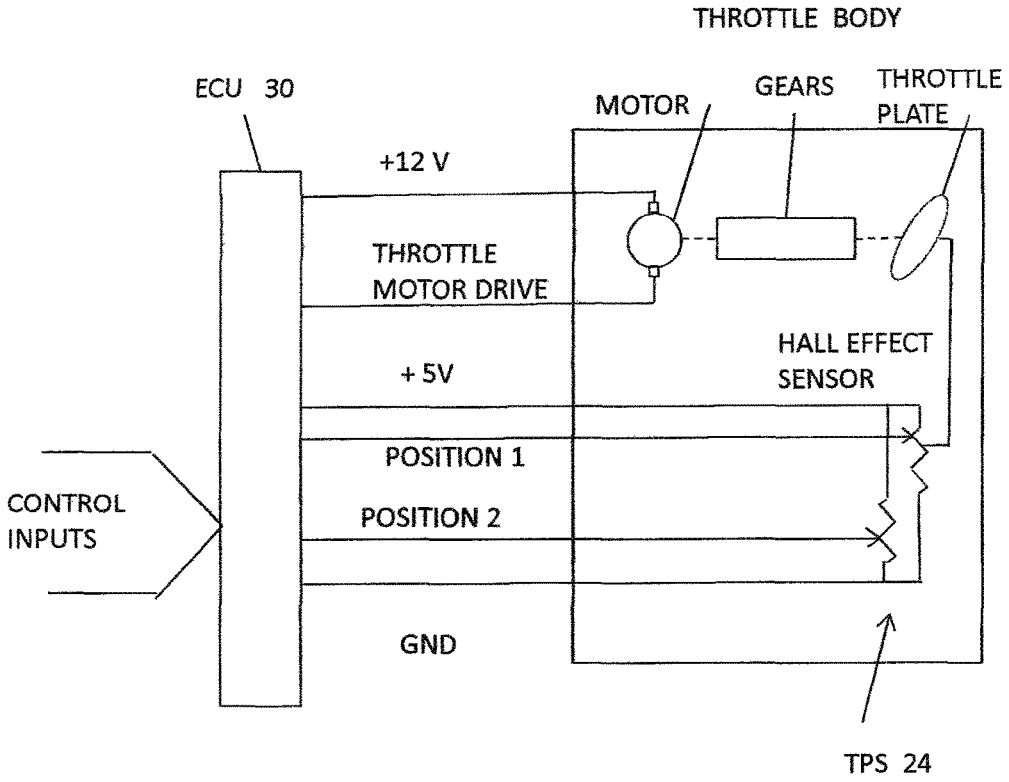
FIG. 3 is a schematic of a throttle body being controlled through an vehicle's ECU, prior art.

When the car is performing normally the ECU signals are passed through to the throttle body motor without modification by a throttle motor drive signal. See FIG. 3. It should be understood that a wire or line having a particular signal thereon is also called by that signal name.

Figure 4:
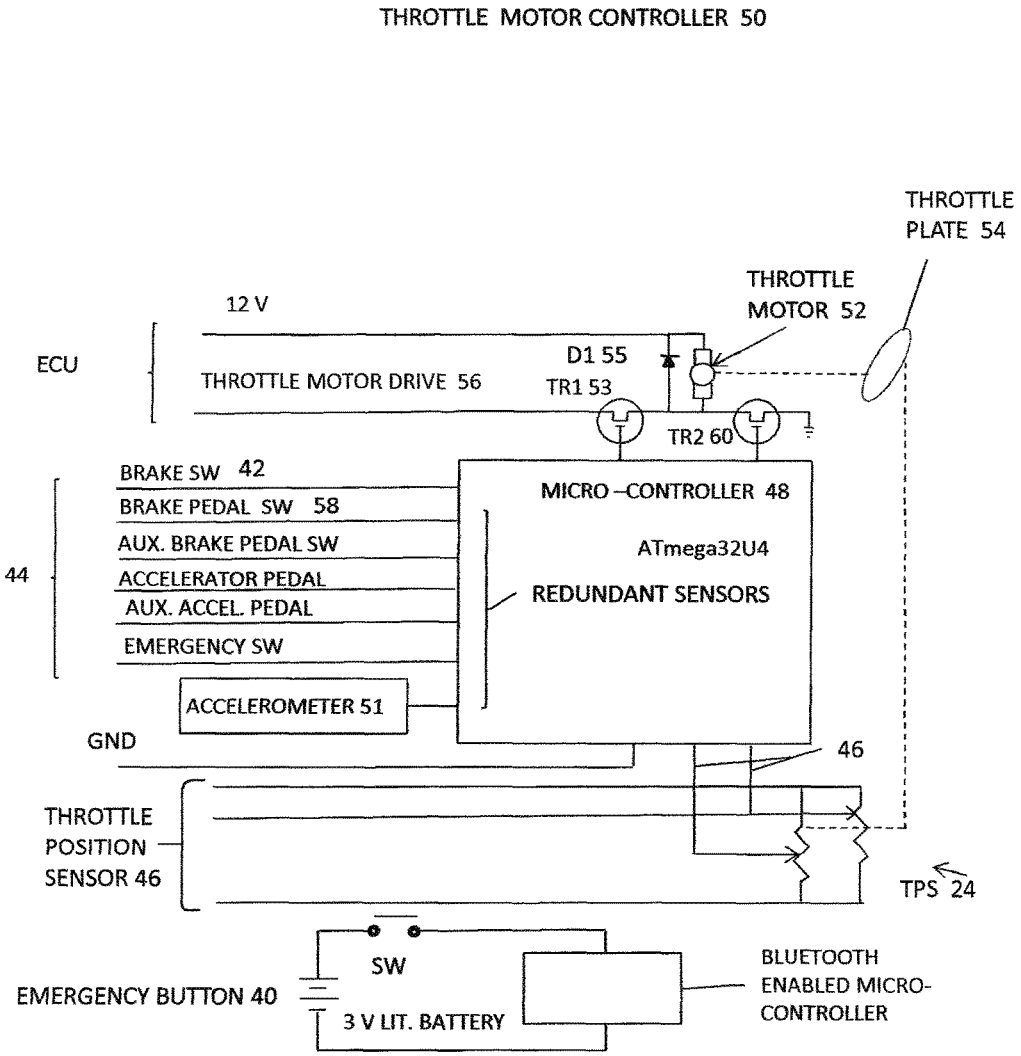
FIG. 4 is a schematic of an fault tolerant throttle motor controller of the present invention and including an emergency button, if needed.

When an unexpected acceleration occurs, a driver actuated Emergency Button 40 or a Brake Switch Signal 42, see FIG. 4, will cause the TMC 50 to enter the emergency mode and reduce the throttle signal to the TBM 52, retarding the throttle plate 54 to a safer position. This slows the engine and stops the sudden acceleration. Both the TB 40 and Brake Signal 42 can be directly wired or use Bluetooth to communicate with the TMC 50. As seen in FIG. 4, control of the throttle motor drive 56 comes from the ECU 30, FIG. 3. The micro-controller 48, being a ATmega32U4 part, receives signals from the brake switch 42, the throttle motor driver 56, the brake pedal switch 58, axillary brake pedal switch, axillary accelerator pedal and accelerator pedal, 44, the emergency button switch 40, accelerometer 50 if used, and the throttle position sensor 46. A correction signal 60 is output to the throttle motor 52 from the throttle motor controller 48.

Figure 5:
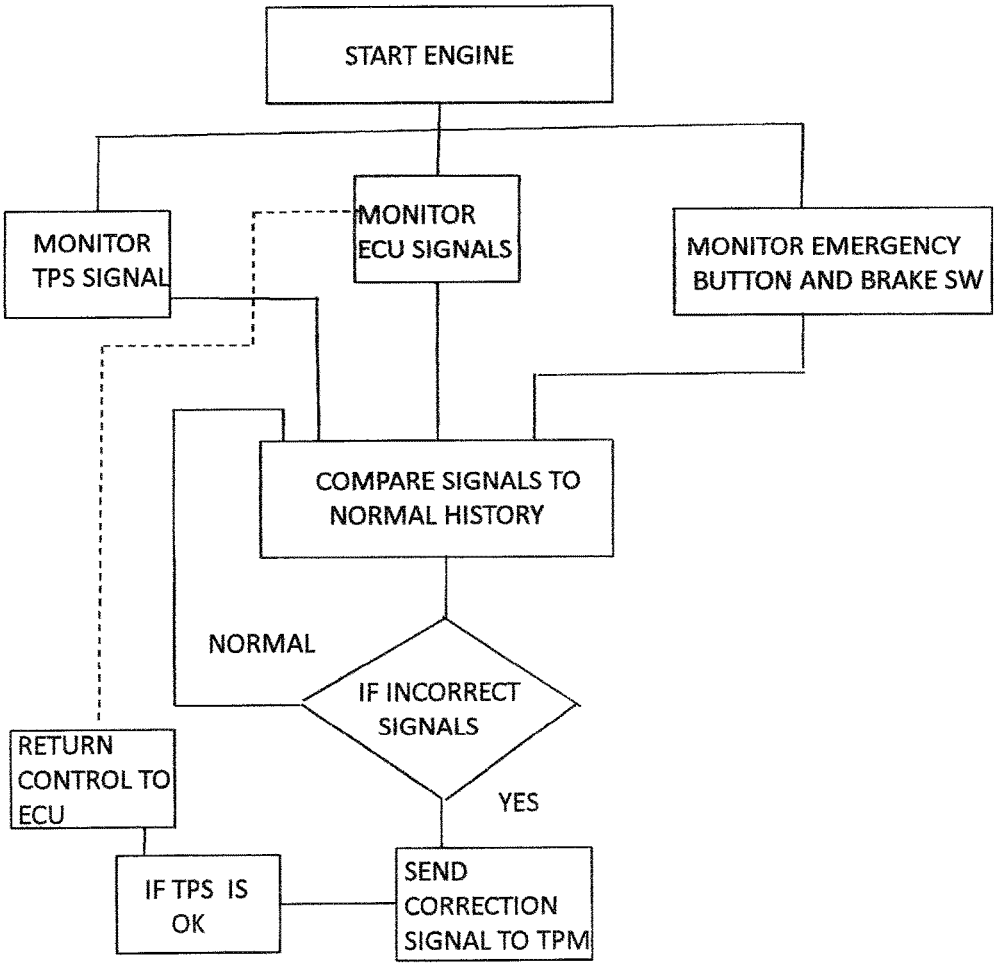
FIG. 5 is a general flow chart of the micro-controller as coded for the present invention.

FIG. 5 is a generalized flow chart showing the operation of the TMC. The micro-coding to support the present invention, would be known to one skilled in the art.

If the Emergency Button 40 or brake pedal switch 58 is actuated long enough the TMC 52 will accurately return the throttle plate to idle position using the throttle position sensor as a reference. If the brake is released the progress of the throttle plate toward idle will halt and will resume if the brake is reapplied.

If the ECU is no longer issuing erroneous acceleration signals the TMC will return control to the ECU. Turning off the engine will reset the TMC allowing the ECU to operate the throttle motor normally when the engine is next started.

The new and improved fault tolerant throttle body contains the following components as listed in Table 1, but not limited thereto:

TABLE 1

| | |
|---|---|
| 1 | Throttle casting; |
| 2 | Throttle plate; |
| 3 | Throttle plate position sensor; |
| 4 | Throttle plate return spring; |
| 5 | Throttle motor; |
| 6 | Micro-Controller; |
| 7 | Accelerometer in a vibration resistant mount; |

TABLE 1-continued

| | |
|---|---|
| 8 | RFI and EMI shielding of cabling including, in particular, shielded wiring to brake switch or gas pedal sensor that includes filtering; |
| 9 | Shielded and Self-contained throttle body inherently EMI proofed; |
| 10 | An event log in the Micro-Controller that records throttle plate sensor history and that modifies throttle plate position based on prior history |
| 11 | Uses throttle history and brake sensor to determine emergency mode. |
| 12 | Uses throttle history and brake sensor to continuously adjust throttle position. |
| 13 | Able to drive throttle motor backwards. |
| 14 | All inputs have filtering. |
| 15 | Start/Stop switch as additional input. |

When the car is in motion the Start/Stop switch button is used to enter the emergency mode. To do this, the TMC monitors the Start/Stop switch and the throttle position history. As long as the Start/Stop button is pressed, the throttle plate position is progressively driven toward the idle position. When the Start/Stop switch is released, the throttle plate is maintained. Further, the actuation of the Start/Stop switch will eventually drive the throttle plate position to idle. Once stopped the Start/Stop switch can be expected to perform its normal function.

The new and improved fault tolerant throttle body microcontroller 48 contains the following features, but not limited to as noted in TABLE 2:

TABLE 2

| | |
|---|---|
| 1 | Auxiliary input for brake switch signal. |
| 2 | Auxiliary input for communicating with any other brake sensor separate from the brake switch signal. |
| 3 | Auxiliary input communicating with a secondary gas pedal sensor signal. |
| 4 | Input for accelerometer signals. |
| 5 | Bluetooth for communicating to external sensors and devices via signal wires. |
| 6 | Emergency/Parking Brake, when engaged returns the throttle plate to idle position. |
| 7. | Input for the Throttle Positon Sensor. |

The new and improved fault tolerant throttle body micro controller 48 is programmed with microcode, FIG. 5, with the following features noted in TABLE 3:

TABLE 3

| | |
|---|---|
| 1 | Monitors and stores input sensor readings into an active readings table for history in RAM 70. |
| 2 | Contains a table of permissible ranges of sensor values in ROM 62. |
| 3 | Compares active and permissible sensor tables and history to detect an unintended acceleration. |
| 4 | When an unintended acceleration is detected, the TMC modifies ECU signal to throttle body motor to correct the fault. |
| 5 | Stores fault data for later retrieval in RAM 60. |
| 6 | Allows access to the fault data using an external serial or Bluetooth enabled device. |
| 7 | Allows modification of program parameters or to have new microcode downloaded into its program memory from an encoded external serial or Bluetooth enabled device. |

Emergency Transmit Button (TB) Schematic and Description:

The Transmit or Emergency Button (TB) 40 is a BlueTooth micro-controller with a lithium battery and a push button. It pairs with the BlueTooth imbedded in the throttle body micro controller (TBC). It can also be hard wired to the TBC. Its small size allows it to be mounted where it is easily accessible by the driver.

Figure 6:
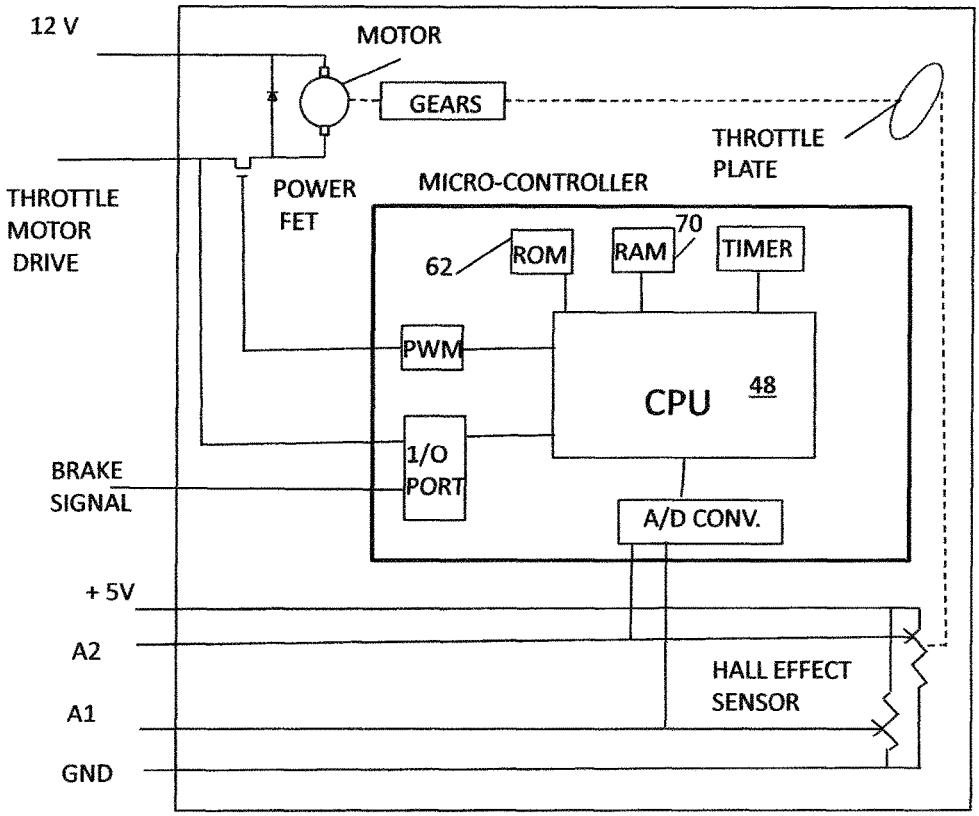
FIG. 6 is a further view of the micro-controller 48 details.

Fault Tolerant Throttle Motor Controller Schematic and Description in FIG. 6:

The micro controller 48 monitors a multitude of signals to detect an unintended acceleration fault: ECU drive to throttle motor 56 signal, throttle position sensor 46 signal, brake signal from master cylinder 42, Emergency Switch 40, and accelerometer 51. The micro controller 48 monitors additional signals 44 to assure that a fault condition is reliably detected in spite of multiple sensor failures. These are: throttle pedal position 46, auxiliary throttle pedal position, brake pedal position, and auxiliary brake pedal position 44.

The ECU Throttle Motor Drive 56 signal is a Pulse Width Modulated (PWM) signal that drives the Throttle Plate Motor 52 through TR1 53, which is normally on. When the system is in Protect Mode TR1 53 is driven by a shorter microcontroller PWM signal from the microcontroller 48 in synchronism with the ECU PWM signal, causing the pulses to the Throttle Body Motor 52 to be foreshortened which reduces the position of the throttle plate 54. Thus in Protect Mode. The drive to the Throttle Plate Motor 52 is under microcontroller 48 control allowing it to gradually reduce the throttle plate to a safer position. If the ECU Throttle Motor Drive 56 is inoperable TR2 60 is used to drive the Throttle Plate Motor 52 and maintain a safe throttle plate position. Diode D1 55 is used to suppress the inductive transients from the Throttle Plate Motor 52 when either TR1 53 or TR2 60 are turned off.

In normal conditions the throttle motor 52 is driven directly by the ECU 30 through transistor TR1 53. When a fault condition is detected the micro controller 48 modulates TR1, reducing the drive signal to the throttle motor 52 and causes the throttle plate 54 to return toward idle. Transistor TR2 60 is used to provide a throttle motor drive signal in case of total failure of the ECU throttle motor drive signal.

The present invention provides a method for preventing the unintended acceleration of a vehicle, said method comprising the steps of:

determining if an acceleration is unintended by monitoring the Throttle Motor Drive, the Throttle Position Sensor or the Brake Switch Signal;

if unintended, the throttle motor controller enters an emergency mode and adjusts the throttle signal to the throttle body motor to place the throttle plate in a safer position with reference to the throttle plate sensor; and if the engine control unit (ECU) is no longer outputting incorrect signals, the throttle motor controller (TMC) returns control to the ECU. The Throttle Motor Controller (TMC) may also input data into an event log that can be accessed by a serial or Bluetooth device to help technicians diagnose and repair the vehicle.

As a further embodiment, The Fault Tolerant Throttle Body (FTTB) can be retro fitted into existing Toyotas, for example, and other cars, thus providing extra protection without requiring alteration of existing ECU microcode.

Figure 7:
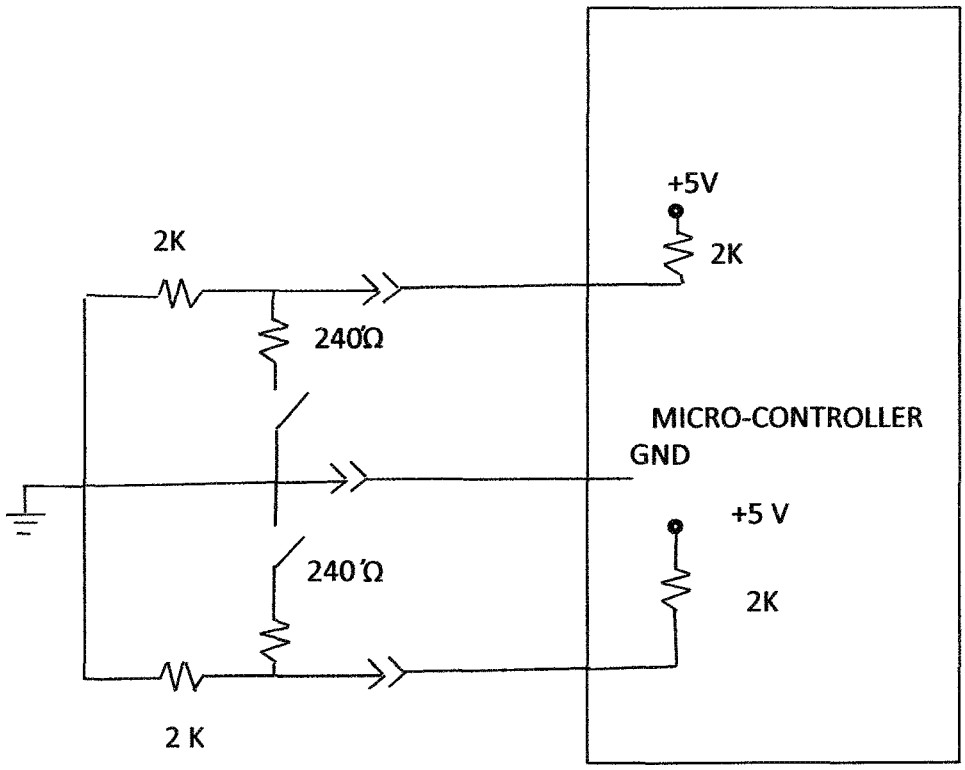
FIG. 7 shows a schematic of a fault tolerant dual contact closure of the present invention.

Fault Tolerant Contact Dual Closure:

Referring to FIG. 7, by adding a second contact to critical switches such as the Start/Stop switch and the Brake Switch they can be made redundant. However by adding two resistors to each contact closure and monitoring the signal with one of the A/D Converter inputs in the host device the following can be sensed: contact open, contact closed, connecting wire open, connecting wire shorted to +voltage, connecting wire shorted to ground. This makes the connections fault tolerant. On the FTTB this would make all contact closure inputs redundant especially the brake sensor.

Hall Effect Outputs:

The two Hall effect sensor outputs are connected to the microcontroller nominally to allow monitoring these two signals. However, the microcontroller pins are multi functional and can drive as well as monitor the two Hall effect signals. By driving the Hall effect sensor outputs this can do:

Fault Reporting:

When entering the Protect Mode or having a Brake Sensor wiring fault this drives one of the Hall effect sensor signals they will no longer be in balance. This would be interpreted by the ECU as a throttle body fault. This allows the FTTB to report problems without modifying the existing ECU microcode. In some ECUs this fault might light the Check Engine light.

Serial Communication:

When the engine is not running the two Hall effect outputs can be used as a serial data link between the FTTB and the ECU. One line is serial data to the ECU and the other line is serial data from the ECU. This would allow sending error data packets to the ECU. This would require an ECU microcode modification.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A fault tolerant throttle body for preventing an unintended acceleration of a vehicle by returning a throttle plate in a throttle body to a safe condition, said fault tolerant throttle body comprising:

a throttle motor controller (TMC), said throttle motor controller positioned in/on a throttle body assembly of said vehicle, said throttle motor controller comprises:

a micro-controller, said micro-controller receiving signals and modifying signals from an engine control unit (ECU) to a throttle body motor (TBM), said micro-controller receiving signals from:

said engine control unit (ECU);

one or more brake sensors;

a throttle position sensor; and wherein the signal received from the engine control unit (ECU) is a throttle motor drive signal that drives the throttle body motor (TBM), and wherein, in a protect mode, the throttle motor drive signal is modified by the micro-controller to cause a throttle plate to move gradually towards a safe position to prevent unintended acceleration.

2. The fault tolerant throttle body as defined in claim 1, further including an emergency transmit button actuated by a driver of the vehicle or a Start/Stop button to initiate an emergency mode.

3. The fault tolerant throttle body as defined in claim 1, further including an accelerometer.

4. The fault tolerant throttle body as defined in claim 1, further including said micro-controller having an emergency switch signal, a brake pedal switch signal, an auxiliary brake pedal switch signal, an accelerator pedal switch signal, and auxiliary accelerator pedal switch signal.

5. The fault tolerant throttle body as defined in claim 1, wherein said Throttle Motor Driver includes a source of power, a drive signal from the ECU, a diode to control transients, and one or two power FETS for controlling said throttle motor.

6. The fault tolerant throttle body as defined in claim 1, wherein the TMC monitors the Start/Stop button signal and throttle position history to enter an emergency mode to stop unintended accelerations.

7. The fault tolerant throttle body as defined in claim 2, further including a second contact in a Start/Stop circuit for redundancy of said Start/Stop button.

8. A method for preventing the unintended acceleration of a vehicle, said method comprising the steps of:

determining if an acceleration is unintended by monitoring vehicle and engine signal history;

if unintended, a throttle motor controller enters a protect mode wherein a micro-controller adjusts a throttle motor drive signal from an engine control unit (ECU) to the throttle body motor to move the throttle plate towards a safe position using the throttle plate sensor as a reference; and if the engine control unit (ECU) is no longer outputting incorrect signals, the throttle motor controller (TCM) returns control to the ECU, wherein said method is programmed into the throttle motor controller of a fault tolerant throttle body.

9. The method as defined in claim 8, wherein said engine signals comprise the ECU, an emergency button, a brake switch signal and a throttle position sensor signal.

10. The method as defined in claim 8, further including monitoring one or more of the following: Throttle Motor Drive, the Throttle Position Sensor, and the Emergency Button and the Brake Switch signals.

11. The method as defined in claim 8, further including monitoring an axillary brake pedal switch and an axillary accelerator pedal switch and an accelerometer.

12. The method as defined in claim 8, wherein the TMC monitors the Start/Stop button signal and throttle position history to enter an emergency mode to stop unintended accelerations.

13. The method as defined in claim 8, further including the step of retrofitting the TMC into existing vehicles.

* * * * *